US011476553B2

(12) United States Patent
Bru et al.

(10) Patent No.: US 11,476,553 B2
(45) Date of Patent: Oct. 18, 2022

(54) WIDEBAND ORTHOMODE TRANSDUCER

(71) Applicant: THALES, Courbevoie (FR)

(72) Inventors: Laurent Bru, Revel (FR); Pierre Bosshard, Tournefeuille (FR); Ségolène Tubau, Toulouse (FR); Erwan Cartaillac, Labatut (FR); Nicolas Ferrando, Tournefeuille (FR)

(73) Assignee: THALES, Courbevoie (FR)

( * ) Notice: Subject to any disclaimer, the term of this patent is extended or adjusted under 35 U.S.C. 154(b) by 0 days.

(21) Appl. No.: 17/317,757

(22) Filed: May 11, 2021

(65) Prior Publication Data

US 2021/0359383 A1 Nov. 18, 2021

(30) Foreign Application Priority Data

May 15, 2020 (FR) ..... 2004878

(51) Int. Cl.
*H01P 1/161* (2006.01)
*H01P 1/213* (2006.01)
*H01Q 19/13* (2006.01)

(52) U.S. Cl.
CPC ..... *H01P 1/161* (2013.01); *H01P 1/213* (2013.01); *H01Q 19/13* (2013.01)

(58) Field of Classification Search
CPC ..... H01P 1/161; H01P 1/213; H01Q 19/13
See application file for complete search history.

(56) References Cited

U.S. PATENT DOCUMENTS

| | | | | |
|---|---|---|---|---|
| 3,715,688 | A | 2/1973 | Woodward | |
| 11,081,766 | B1 * | 8/2021 | Wrigley | H01Q 1/288 |
| 2013/0307719 | A1 | 11/2013 | Granet et al. | |

FOREIGN PATENT DOCUMENTS

| | | | |
|---|---|---|---|
| EP | 2 202 839 | A1 | 6/2010 |
| GB | 835 575 | A | 5/1960 |
| GB | 2 054 974 | A | 2/1981 |

* cited by examiner

*Primary Examiner* — Samuel S Outten
*Assistant Examiner* — Kimberly E Glenn
(74) *Attorney, Agent, or Firm* — BakerHostetler

(57) ABSTRACT

An orthomode transducer and to a satellite transmission chain includes the orthomode transducer, for transmitting a first signal and a second signal in orthogonal propagation modes. The transducer comprises: a primary waveguide with a square or rectangular cross section, two guided access means having firstly a free end via which the first signal and the second signal are respectively injected or recovered, and secondly two arms connected to the primary waveguide. Each guided access means comprises a junction configured so as to connect the free end to the two arms of the guided access means, the two arms of each guided access means being connected to the primary waveguide at two off-centred locations on one or more sides of the primary waveguide symmetrically about an axis of symmetry of the primary waveguide.

9 Claims, 11 Drawing Sheets

WIDEBAND ORTHOMODE TRANSDUCER

CROSS-REFERENCE TO RELATED APPLICATIONS

This application claims priority to foreign French patent application No. FR 2004878, filed on May 15, 2020, the disclosure of which is incorporated by reference in its entirety.

FIELD OF THE INVENTION

The invention lies in the field of microwave transmissions, and relates more particularly to an orthomode transducer used to transmit two signals with orthogonal polarizations.

Although the proposed solution is particularly useful in the field of antenna sources, and in particular satellite antennas, it is not limited to these applications, and the orthomode transducer according to the invention may also be used for other devices, such as for example for producing microwave filters or duplexers.

BACKGROUND

In order to maximize their spectral efficiency, satellite-based transmission systems generally use polarization diversity, which consists in transmitting two orthogonally polarized signals on the same frequency band (for example a vertical polarization and a horizontal polarization, or a right-hand circular polarization and a left-hand circular polarization). When the polarizations between the two signals are perfectly orthogonal, the signals may be recovered independently, thereby making it possible to transmit or to receive two signals simultaneously in the same frequency band, or else to transmit and to receive simultaneously in the same frequency band, from a single antenna.

In theory, the decoupling between the two signals is infinite, thereby allowing them to be perfectly dissociated. In practice, asymmetries in the transmission equipment create an angular factor in the electric fields. In this case, a subcomponent of each polarization is coincident with the cross polarization, thereby leading to coupling phenomena between the signals. Those skilled in the art therefore take care to ensure that the two orthogonally polarized signals are transmitted with the greatest possible decoupling.

Orthomode transducers, or signal duplexers (also known by the name orthogonal mode transducer, or OMT) are devices belonging to the power supply chain of an antenna, in particular of a satellite antenna. FIG. 1*a* shows, highly schematically, a transmission chain for an antenna. It comprises a source, generally a horn 101, via which the satellite signals are transmitted/received, and an orthomode transducer 102, in the form of a waveguide via which two signals $S_1$ and $S_2$ 103 and 104 are injected/extracted. The orthomode transducer is configured so as to combine or split the two signals by applying an orthogonal polarization to them. Depending on the embodiment, other signals associated with other frequency bands may be injected into/extracted from the transducer 102.

Numerous telecommunications satellites are equipped with an antenna array, consisting of a large number of transmission chains such as the one shown in FIG. 1*a*, making it possible to achieve geographical coverage through beams. FIG. 1*b* shows, highly schematically, the components of an antenna array. It comprises a plurality of sources 111 to 116, each associated with one or more beams. An orthomode transducer 121 to 126 is associated with each source, thus allowing two orthogonally polarized signals to be transmitted in the one or more beams in question, generally one signal in transmit mode and one signal in receive mode. The dimensions and the shape of the waveguides forming the orthomode transducer are chosen on the basis of the frequency of the transmitted signals, so as to allow electromagnetic waves to propagate in controlled electrical transverse modes.

The antenna array on board satellites may comprise several tens of transmission chains, and therefore the same number of orthomode transducers. The bulk and the mass of these devices are therefore highly decisive elements when designing satellite antennas.

In the remainder of the description, and in order to simplify understanding of the applicable physical phenomena, the explanations are given considering the case of application of two signals injected onto the orthomode transducer for the purpose of being orthogonally polarized and combined and then transmitted by the source of the satellite antenna. However, the invention is applicable identically in the case of two signals with orthogonal polarizations and received from the source of the satellite antenna and transmitted and split by the orthomode transducer, or in the case in which one signal is transmitted and the other one is received.

Orthomode transducers have a square central core that is configured so as to allow the transmission of a first signal in a TE10 propagation mode, in which the electric field of the signal is linear and vertical, and a second signal in a TE01 propagation mode, in which the electric field of the signal is linear and horizontal. The two signals are then orthogonally polarized and may be transmitted simultaneously. The central core may be rectangular in order to propagate signals in separate frequency bands. Likewise, the signals may be transmitted with circular polarizations by combining for example a coupler with the orthomode transducer, such that each signal is transmitted in a first mode, on the one hand, and in delayed and phase-offset form in a second mode, on the other hand. The resultant electric field is then rotating, thereby creating a circularly polarized signal.

Several different structures of orthomode transducers are known from the prior art.

FIG. 2*a* shows a three-dimensional view of an orthomode transducer with two branches, which constitutes the simplest, most compact, most economical and therefore most widespread type of orthomode transducer. It consists of a primary waveguide 201 extending along a longitudinal axis zz'. The waveguide is designed to propagate two fundamental electromagnetic modes in the frequency band under consideration. In practice, since the two signals are in the same frequency band, this result is achieved using a waveguide with a square cross section whose size is dimensioned with respect to the minimum frequency of the frequency band under consideration, but the waveguide may adopt any shape allowing the two signals to propagate in the desired modes.

The primary waveguide is connected, at a first side, along its longitudinal axis zz', to a source, a radiating element matching the waveguide and free space. The primary waveguide 201 is connected to two guided access means 202 and 203 via which the two signals to be transmitted are injected. The junctions between the guided access means and the primary waveguide are formed at the same level of the primary waveguide, in a plane xy orthogonal to the axis zz', through slots produced in the middle of orthogonal walls of the primary guide, with the result that signals injected via the two guided access means are combined with orthogonal polarizations in the primary waveguide before being transmitted to the source (and by contrast, allowing the orthogonally polarized signals to be extracted from each of the access means). The back of the primary waveguide 201 along the longitudinal axis zz' may be connected for example to other access means for injecting signals in a separate frequency band.

FIG. 2*b* describes the principle of polarizing signals in a waveguide with two branches, in a sectional view in the plane xy. The first signal, intended to be vertically polarized, is injected onto the first guided access means 202. The solid arrows give the direction of the electric field of the first signal, perpendicular to the direction of propagation of the electromagnetic wave. In the primary waveguide 201, the first signal propagates with the TE10 fundamental propagation mode, corresponding to a vertical polarization. The second signal, intended to be horizontally polarized, is injected onto the second guided access means 203. The dotted arrows give the direction of the electric field of the second signal, perpendicular to the direction of propagation of the electromagnetic wave. In the primary waveguide 201, the second signal propagates with the TE01 fundamental propagation mode, corresponding to a horizontal polarization. Within the primary waveguide 201, the two signals propagate in orthogonal propagation modes.

As shown in FIG. 2*c*, an orthomode transducer with two branches may be combined with a 90° coupler in order to circularly polarize the two signals. The 90° coupler 210 is connected to the guided access means 202 and to the guided access means 203 via two ends. The signal intended to be transmitted with a polarization, for example the LHCP (abbreviation for left-hand circular polarization) polarization, is injected onto the end 211 of the coupler. It is then provided to the guided access means 202, and to the guided access means 203 in a manner delayed and phase-offset by 90°. In the same way, the signal intended to be transmitted with the cross polarization, here the RHCP (abbreviation for right-hand circular polarization) polarization, is injected onto the end 212 of the coupler. It is then provided to the guided access means 203, and to the guided access means 202 in a version delayed and phase-offset by 90°. The delays and phase offsets that are applied have the effect of rotating the electric field, and therefore of circularly polarizing the signals.

FIG. 2*d* shows the electric field of the signal injected onto the guided access means 203 of an orthomode transducer with two branches, in a sectional view in the plane xy orthogonal to zz' at the junction between the guided access means and the primary guide 201. The greyscale levels represent the intensity of the electric field and the arrows represent its direction.

The signal injected via the guided access means 203 propagates within the primary waveguide 201 with the propagation mode TE01, that is to say that it is linear and horizontal. Within the primary waveguide, the electric fields are not perfectly aligned. These slight distortions are linked to the sensitivity of the electric field to the asymmetries present on a centred access means, and have the effect of producing coupling phenomena between the two orthogonally polarized signals.

Furthermore, a small portion of the signal injected via the access means 203 propagates into the guided access means 202. Since the electric field is always perpendicular to the support, it rotates while entering the guided access means 202. Residuals of the signal transmitted on the access means 203 are then encountered on the guided access means 202 with the same polarization as the signal transmitted on this access means (vertical linear), thereby causing additional stray coupling phenomena. For this reason, the decoupling generally achieved using an orthomode transducer with two branches is of the order of −20 dB. This level of decoupling may prove to be too poor for a certain number of applications, such as for example for satellite antennas, where losses linked to decoupling translate into a degradation in the link budget and therefore in achievable throughputs.

One known way of improving decoupling between the paths of an orthomode transducer with two guided access means is described in patent EP 2,202,839 B1 and shown in FIG. 2*e*, in a sectional view, for circularly polarized signals. The device comprises a coupler with unbalanced branches 231, making it possible to transmit each of the signals in controlled proportions on the guided access means 202 and 203 of an orthomode transducer with two branches, and short-circuited waveguides (stubs) 232 and 233 configured so as to filter the signals. The partition coefficients of the coupler 231 are adjusted so that a portion of a polarization of the signal injected onto one path is injected onto the other path, with a highly precise phase calibration that makes it possible to cancel out the portion of stray energy linked to incorrect decoupling. This operation is managed by acting on the short-circuited waveguides of the filters 232 and 233 of the transmission path that make it possible, in addition to rejecting the reception band, to place the cross component in phase quadrature with respect to the primary component.

This solution makes it possible to achieve high levels of decoupling, but is difficult to implement and bulky.

Another way of improving decoupling of an orthomode transducer with two access means is shown in FIG. 2*f*. The access means are always injected orthogonally onto the waveguide 201, but are offset in the axis zz' of the source. This waveguide makes it possible to achieve high levels of decoupling of around −50 dB, but is bulky.

Orthomode transducers with four branches are also known from the prior art, making it possible to achieve greater decoupling than those with two branches. Such an orthomode transducer is shown in FIG. 3*a*. It consists of a primary waveguide 301 extending longitudinally along an axis zz' and connected to two pairs of waveguides (302/304 and 303/305) forming access means via which the two signals to be transmitted are injected. The two waveguides of the same pair are positioned face-to-face in the same plane orthogonal to the axis zz'. The two waveguides of the other pair are connected to the other two sides of the primary waveguide.

FIG. 3*b* describes the principle of polarizing signals in an orthomode transducer with four branches.

The signal intended to be vertically polarized is injected onto the primary waveguide 301 from the guided access means 303 and 305, which are opposite one another with respect to the primary waveguide 301. The signals injected from the two guided access means are identical, synchronized, in-phase and have the same power level. They then combine constructively in the primary waveguide, and the signal propagates in TE10 mode. Likewise, the second signal, intended to be horizontally polarized, is injected synchronously and in-phase onto the primary waveguide 301 from the guided access means 304 and 306, which are opposite one another with respect to the primary waveguide 301. In this case too, the two injected signals combine constructively, and the signal propagates in the primary waveguide in TE01 propagation mode.

The symmetry of the orthomode transducer with four branches means that the electric field lines are more rectilinear than in a transducer with two branches.

In the same way as in the waveguide with two access means, a portion of the signal injected from the guided access means 303 is encountered in the guided access means 302 with an electric field 310 that is pivoted by 90° and therefore horizontally polarized. Likewise, a portion of the signal injected from the guided access means 305 is encountered in the guided access means 302 with an electric field 311 that is pivoted by 90° and therefore horizontally polarized. Since the signals are injected in-phase from the guided access means 303 and 305, the electric field 310 and the electric field 311 of the residuals of these signals transmitted in the guide 302 are then in phase opposition (180°). They combine destructively, and the residuals of the signals injected via the guided access means 303 and 305 encountered in the guided access means 302 vanish. The principle is the same in each of the waveguides 302 to 305.

The symmetry properties of orthomode transducers with four branches therefore make it possible to obtain a perfectly linear electric field, the cross polarization naturally vanishing in the cross access means. They generally exhibit high levels of decoupling, of the order of −40 dB.

However, generating two identical and in-phase signals for each polarization introduces upstream complexity since it is then necessary to duplicate the generation of the signals, the signals transmitted to one pair of access means having to be perfectly identical and synchronized. The orthomode transducer having four independent access means is also not optimal in terms of compactness.

As an alternative, the guided access means used to inject a given signal may be combined in pairs, taking care that the paths to each injection point are of the same length so that the signals are injected simultaneously and in-phase. The combination circuits are then complex, all the more so since the two guided access means are interwoven, and require a large number of elementary connection components, thus increasing dispersion. The performance ultimately obtained is limited, and ohmic losses are significant, for a bulky and heavy device.

SUMMARY OF THE INVENTION

One object of the invention is therefore to describe an orthomode transducer having a high level of decoupling, that is both easy to implement and compact.

To this end, the present invention describes an orthomode transducer for transmitting a first signal and a second signal in orthogonal propagation modes. The orthomode transducer comprises:

a primary waveguide with a square or rectangular cross section, two guided access means having firstly a free end via which the first signal and the second signal are respectively injected or recovered, and secondly two arms connected to the primary waveguide.

Each guided access means comprises a junction configured so as to connect the free end to the two arms of the guided access means, the two arms of each guided access means being connected to the primary waveguide at two off-centred locations on one or more sides of the primary waveguide, symmetrically about an axis of symmetry of the primary waveguide.

Advantageously, the connection between the primary waveguide and the two arms of a guided access means comprises the two corners of the same side of the primary waveguide.

According to the embodiment of the orthomode transducer according to the invention, the junction of each guided access means is configured such that the signals transmitted on the two arms of a guided access means are in phase or in phase opposition depending on their propagation mode in the primary waveguide.

Advantageously, the two arms of the same guided access means have substantially identical dimensions.

Advantageously, the guided access means are arranged symmetrically about an axis of symmetry of the primary waveguide.

In one embodiment of the described orthomode transducer, each guided access means comprises a particular junction chosen from among an E-plane T-junction and an H-plane T-junction, and two particular arms.

In one alternative embodiment, the two guided access means comprise the same junction in the form of a magic T-junction whose lateral ports are connected to a common pair of arms, the first and the second signal being transmitted via two separate ports of the magic T-junction.

The described invention also relates to a device for transmitting the signals with orthogonal circular polarizations. It comprises:

an orthomode transducer as described above, and a 90° coupler connected to the free ends of the guided access means of the orthomode transducer so as to circularly polarize the first and the second signal.

Lastly, the invention addresses a transmission chain for a satellite antenna comprising a source connected to an orthomode transducer as described above, or a device as described above for transmitting signals with orthogonal circular polarizations.

BRIEF DESCRIPTION OF THE DRAWINGS

The invention will be better understood and other features, details and advantages will become more clearly apparent from reading the following non-limiting description, and by virtue of the following appended figures, given by way of example, among which.

Identical references are used in different figures when the elements that are denoted are identical.

DETAILED DESCRIPTION

Although they exhibit good performance in terms of decoupling, orthomode transducers with four branches from the prior art are difficult to implement and bulky. The invention therefore naturally targets orthomode transducers with two branches.

It is based on the properties of the electromagnetic field, which is oriented perpendicular to the metal walls of the waveguide.

Figure 4A:
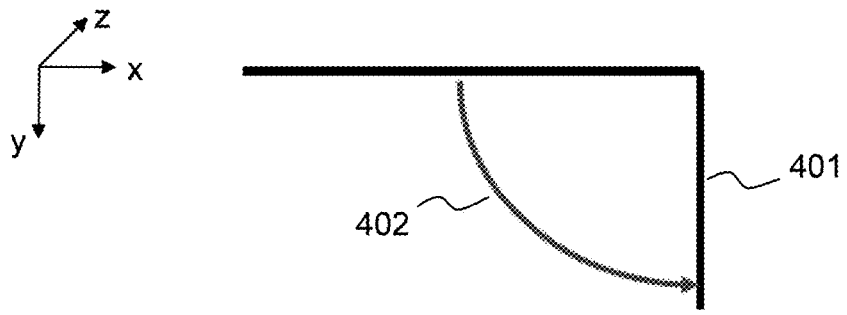
FIG. 4*c* shows a configuration for injecting a signal in an off-centred manner on the sides of a waveguide.
FIG. 4*d* shows a configuration for injecting a signal in an off-centred manner on the sides of a waveguide.
FIG. 4*e* shows a configuration for injecting a signal in an off-centred manner on the sides of a waveguide.

FIG. 4*a* roughly shows the direction of the electric field in the corner of a waveguide 401 with a square or rectangular cross section. Since the electromagnetic field is always perpendicular to the support, in the corner of the waveguide, it is inclined as a function of the distance to the two walls.

Figure 4B:
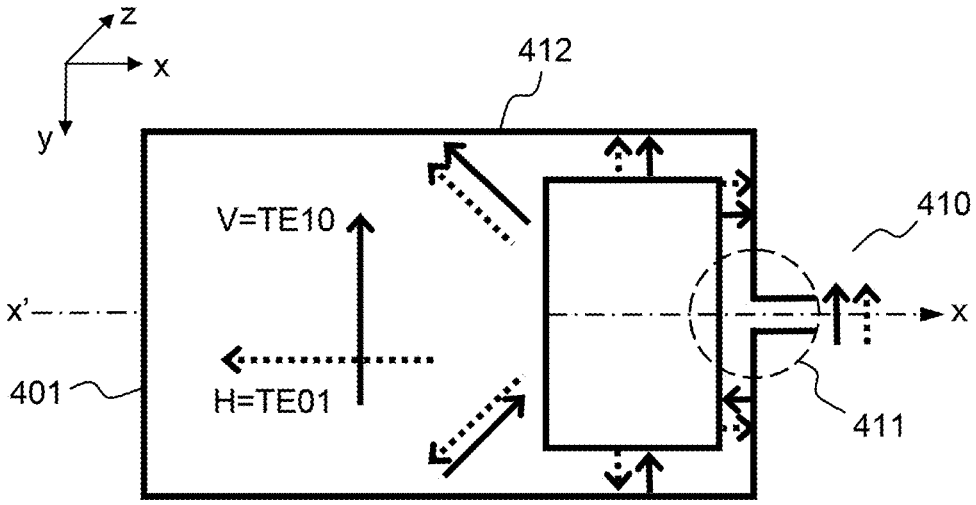

The invention proposes to inject the signals not via access means centred on the sides of the cavity of the primary waveguide of the orthomode transducer, but via off-centred access means located on the edges of one or more sides of this primary waveguide. With just one off-centred injection point, the propagation mode in the waveguide is not controlled, since it is not certain that the electric field in the waveguide will be perfectly linear and oriented in the desired direction. The invention proposes to inject each signal not via one but via two off-centred access means on one or more sides of the primary waveguide, and to do so symmetrically about an axis of symmetry of the primary waveguide. FIG. 4*b* schematically shows the physical principles applicable when injecting a signal via two access means located on the edges of the same side of the primary waveguide.

FIG. 4*b* adopts the example of injecting a first signal into the primary waveguide 401 of an orthomode transducer through a guided access means 410, so that this signal propagates in TE10 mode (vertical linear). The solid arrows show the orientation of the electric field. The signal injected onto the guided access means 410 is split into two signals of the same power by a junction 411 acting as a means for splitting the signals. The junction is connected to two arms 412 and 413 of the same length. The junction may be for example an E-plane microwave T-junction, dividing the signal into two signals in phase opposition and of the same power. The arms of each access means are connected to the primary waveguide 401 via two off-centred slots located at the ends of the right-hand edge of the primary waveguide 401, symmetrically about the axis xx'. The electric fields thereby applied in the corners of the primary waveguide (represented by solid arrows) are not vertical in the corners. However, vector combination of these two injections gives the desired electric field, here a perfectly vertically polarized electric field.

The junction 411 may also be an H-plane microwave T-junction, dividing the signal into two in-phase signals of the same power. In this case, the electric field of the signals (shown by the dotted arrows) at the output of the junction 411 is in-phase. The signal in the primary waveguide 401, resulting from the vector combination of the signals injected via the arms 412 and 413, is then horizontally polarized (TE01 mode, horizontal linear). The type of junction is therefore chosen depending on the desired propagation mode in the primary waveguide.

By injecting the same signal, in phase or in phase opposition, through two off-centred and symmetrical access means in the primary waveguide of an orthomode transducer, it is therefore possible to "force" the propagation mode of the electromagnetic wave. In the example in FIG. 4*b*, in which the arms 412 and 413 of the guided access means 410 are positioned in the corners of a vertical wall of the primary waveguide 401, the junction 411 splits the signal into two signals in phase opposition so as to vertically polarize the signal, or two in-phase signals so as to horizontally polarize it.

Using arms having the same dimensions (same length, same width and same height) makes it possible to inject the signal into the primary waveguide synchronously and with the same power level. One simple means of obtaining arms of the same length is to arrange the entire guided access means symmetrically about the axis of symmetry xx' of the primary waveguide 401.

Figure 4C:
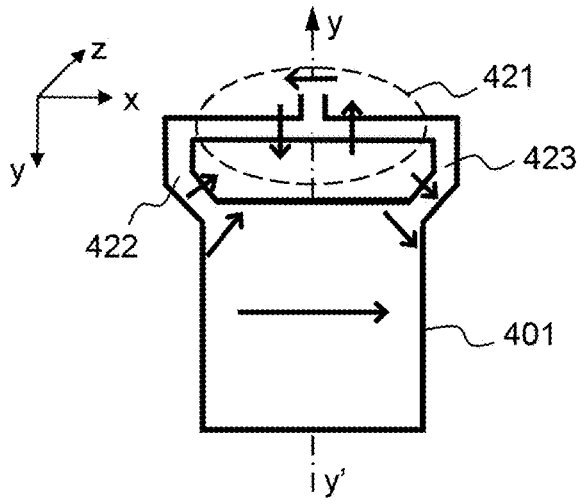
Figure 4D:
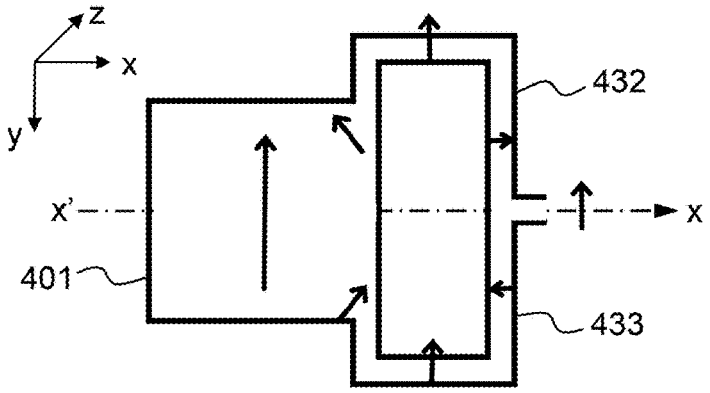
Figure 4E:
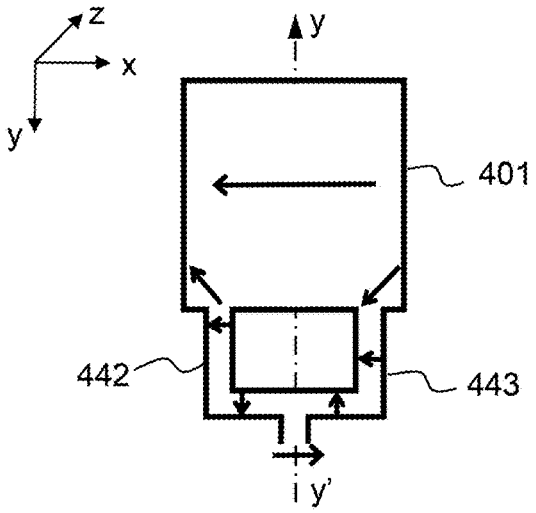

The layout described in FIG. 4*b* is not the only one possible for a guided access means with two arms in an orthomode transducer according to the invention. FIGS. 4*c*, 4*d* and 4*e* describe other configurations for injecting a signal in an off-centred manner on the sides of a primary waveguide 401.

In FIG. 4*c*, the junction 421 is an E-plane T-junction, which generates two signals in phase opposition on the two arms 422 and 423, which inject the signals into the two corners of a horizontal side of the primary waveguide 401, symmetrically about the axis yy'. The propagation mode in the primary waveguide is therefore TE01 mode, that is to say horizontal linear polarization. Using a junction 421 configured so as to generate in-phase signals, such as an H-plane T-junction, the propagation mode that is obtained is TE10 mode, that is to say vertical linear polarization.

In FIG. 4*d*, the two arms are connected to off-centred access means located on two opposing edges of the primary waveguide 401. The access means are always symmetrical about the axis xx'. The electric field evolves as in FIG. 4*b*, in TE10 mode, even though the injection points of the arms 432 and 433 into the primary waveguide are different from those of the arms 412 and 413 in FIG. 4*b*. By using an H-plane T-junction rather than an E-plane T-junction, the signal is horizontally polarized (TE01 mode).

In FIG. 4*e*, the two arms are connected to the same horizontal side of the primary waveguide 401, and are off-centred symmetrically about the axis yy', but without covering the corners. The electric field evolves in the same way as in FIG. 4*c*, even though the layout of the arms and their positioning with respect to the corners of the primary waveguide differ.

The arms of a guided access means therefore do not necessarily meet the primary waveguide 401 in one of its corners, on the condition that the injection points into the primary waveguide are symmetrical about an axis of symmetry of the primary waveguide 401, such that combining the signals injected from the two arms generates a perfectly rectilinear electric field. However, the proximity of the corners improves the performance of the orthomode transducer according to the invention, since the joining slots between the access arms and the central waveguide create magnetic coupling (H field), positioning them in the corners optimizing the efficiency of this coupling.

Figure 5A:
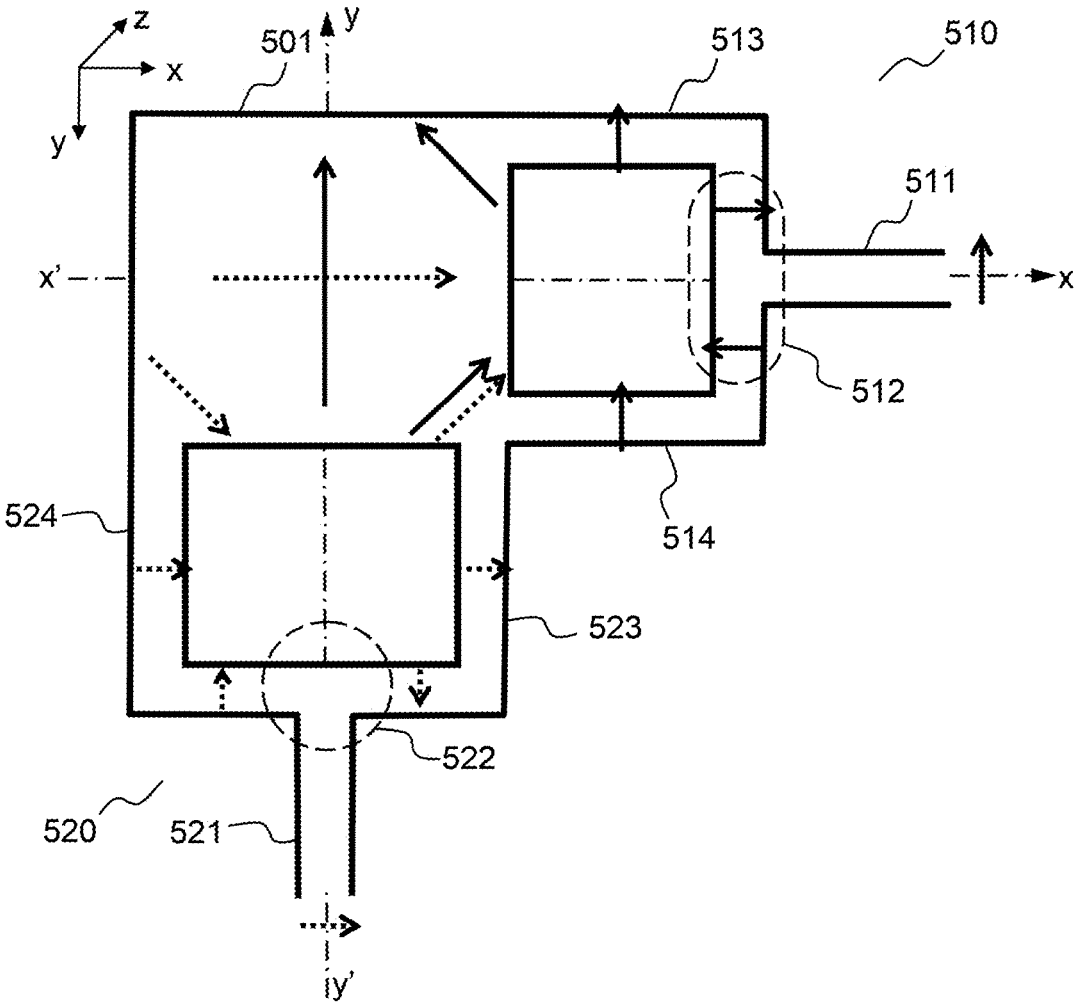
FIG. 5*a* shows one embodiment of an orthomode transducer with two branches according to the invention.

FIG. 5*a* shows one embodiment of an orthomode transducer with two branches according to the invention. The transducer is configured so as to transmit a first signal with a vertical linear polarization, and a second signal with a horizontal linear polarization.

It comprises a primary waveguide 501 with a square cross section, but the invention would also apply identically to a waveguide with a rectangular cross section, in the case of two injected signals operating in different frequency bands. The primary waveguide 501 extends along an axis zz' in which a source for an antenna system may for example be located. It is designed to propagate signals in the two TE10 and TE01 fundamental modes in the one or more frequency bands under consideration. FIG. 5*a* shows the orthomode transducer in a sectional view at the intersections with the guided access means, in a plane xy orthogonal to the axis zz' in which the primary waveguide 501 extends.

A first guided access means 510 is configured so as to inject the first signal into the primary waveguide 501. It comprises a waveguide 511 having a free end via which the signal to be transmitted with vertical polarization is injected, a junction 512 configured so as to divide the first signal into two identical signals of the same power and in phase opposition, such as an E-plane T-junction, and two arms 513 and 514, connected firstly to the junction 512 and secondly to the same side of the primary waveguide in a manner off-centred and symmetrical about its axis xx'. The elements forming the guided access means 510 are dimensioned so as to allow the first signal (the electromagnetic field of which is shown by solid arrows in the figure) to propagate in a fundamental mode in the frequency band under consideration. They may be connected to the primary waveguide 501 through irises that perform impedance matching. The vector combination of the electric fields of the signals injected via the two arms 513 and 514 into the waveguide 501 forms the propagation mode of the signal in the waveguide, that is to say here TE10 mode, corresponding to vertical linear polarization.

In an identical manner, a second guided access means 520 is configured so as to inject the second signal into the primary waveguide 501, at the same level as the first guided access means. It comprises a waveguide 521, via which the signal is injected, connected to a junction 522, configured so as to divide the second signal into two identical signals of the same power and in phase opposition. The two outputs of the junction 522 open onto the arms 523 and 524. The two arms are respectively connected to the edges of the same side of the primary waveguide, symmetrically about its axis of symmetry yy'. The side of the waveguide that is chosen here is the side orthogonal to the one where the arms of the first guided access means are connected. However, in the orthomode transducer according to the invention, any other side could have been selected, since the final polarization of the signal depends on the combination of the positions where the signal is injected by the two arms and on the chosen junction type. The elements forming the guided access means 520 are dimensioned so as to allow the second signal (the electromagnetic field of which is shown by dotted arrows in the figure) to propagate in a fundamental mode in the frequency band under consideration. They may be connected to the primary waveguide 501 via slots provided with irises for the impedance matching. The vector combination of the electric fields of the signals injected via the two arms 523 and 524 makes it possible to form the propagation mode of the signal in the waveguide, here TE01 mode, corresponding to horizontal linear polarization.

The orthomode transducer according to the invention therefore makes it possible, from two access means 510 and 520, to combine two signals with the desired cross polarizations in the primary waveguide 501.

Figure 5B:
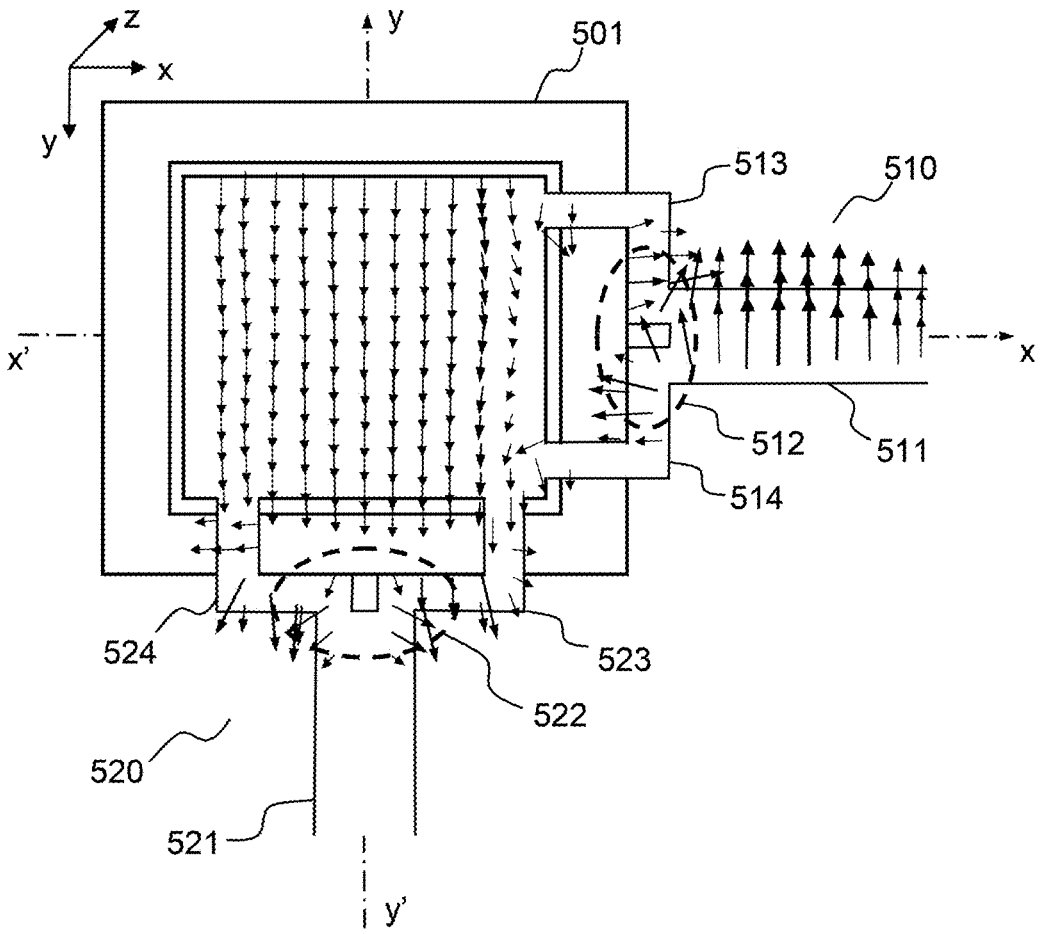
FIG. 5*b* shows the electric field of the signal injected onto the access means 510 of an orthomode transducer with two branches according to one embodiment of the invention.

FIG. 5*b* shows the electric field of the signal injected onto the access means 510 of an orthomode transducer with two branches according to one embodiment of the invention, in a sectional view in the plane xy at the intersection between the guided access means and the primary guide 501. The length and the direction of the arrows show the intensity and the direction of the electric field.

The electric field in the access means 510 evolves such that the vector combination of the signal injected in-phase through the arms 513 and 514 propagates in the primary waveguide in TE10 mode, that is to say vertically polarized. It is observed that the electric field is oriented far more precisely than in an orthomode transducer with two access means shown in FIG. 2*d*, due to the symmetry of the access means with two branches: the decoupling between the polarizations is therefore greater.

A portion of the energy injected from the guided access means 510 propagates in the arms 523 and 524 of the guided access means 520, where the electric field rotates so as to be oriented horizontally. The in-phase junction 522 (E-plane T-junction) then acts as a means for combining the signals in phase opposition. Since the position of the two arms is symmetrical about the axis of symmetry yy' of the primary waveguide 501, the signals transmitted in the two arms are identical and of the same power. The orientation of the electric field means that they are in phase opposition (180°) in the access means 521. They therefore cancel one another out, and the residuals of the signal transmitted by the guided access means 510 and received in the junction 522 naturally vanish in the waveguide 521. There are therefore no or only few coupling effects caused by residuals of a signal in the guided access means for the cross polarization signal.

The phenomenon is the same in the other direction, where residuals of the signal transmitted by the access means 520 are in phase opposition in the arms 513 and 514. Their combination by the junction 511 in phase opposition means that the horizontally polarized signal vanishes at output. There are therefore no or only few coupling effects in this direction as well.

Figure 1A:
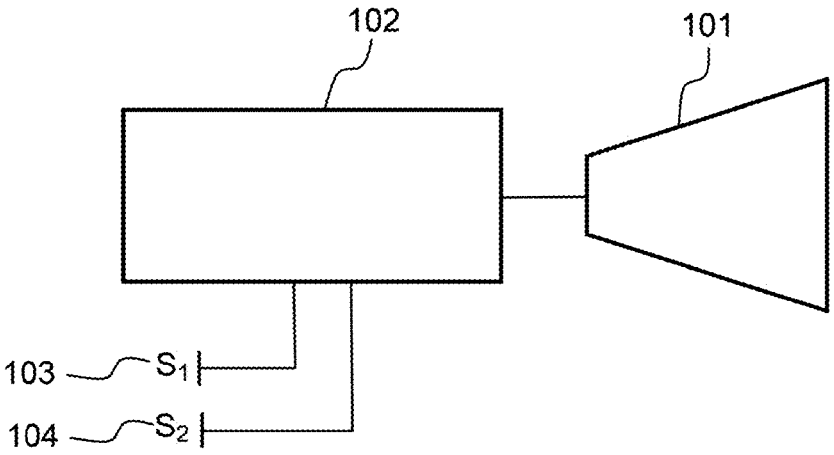
FIG. 1*a* shows, highly schematically, a transmission chain for an antenna, for example a satellite antenna.
Figure 1B:
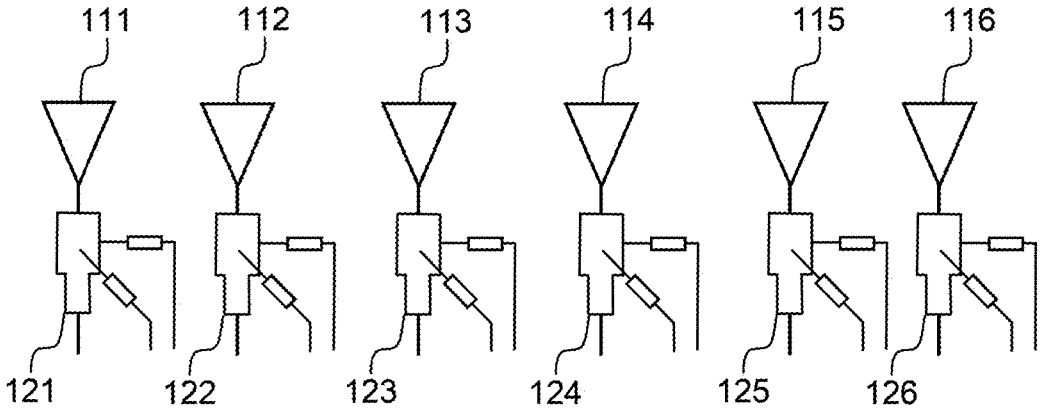
FIG. 1*b* shows, highly schematically, the components of an antenna array on board a satellite.
Figure 2A:
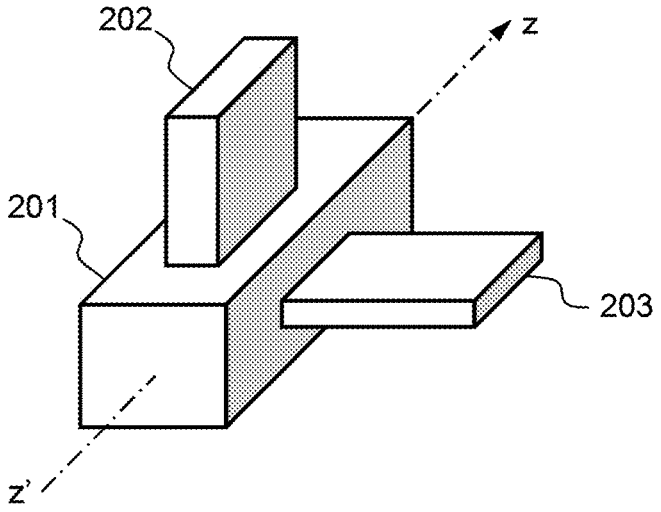
FIG. 2*a* shows a three-dimensional view of an orthomode transducer with two branches according to the prior art, FIG. 2*b* describes the principle of polarizing signals in a waveguide with two branches.
Figure 2B:
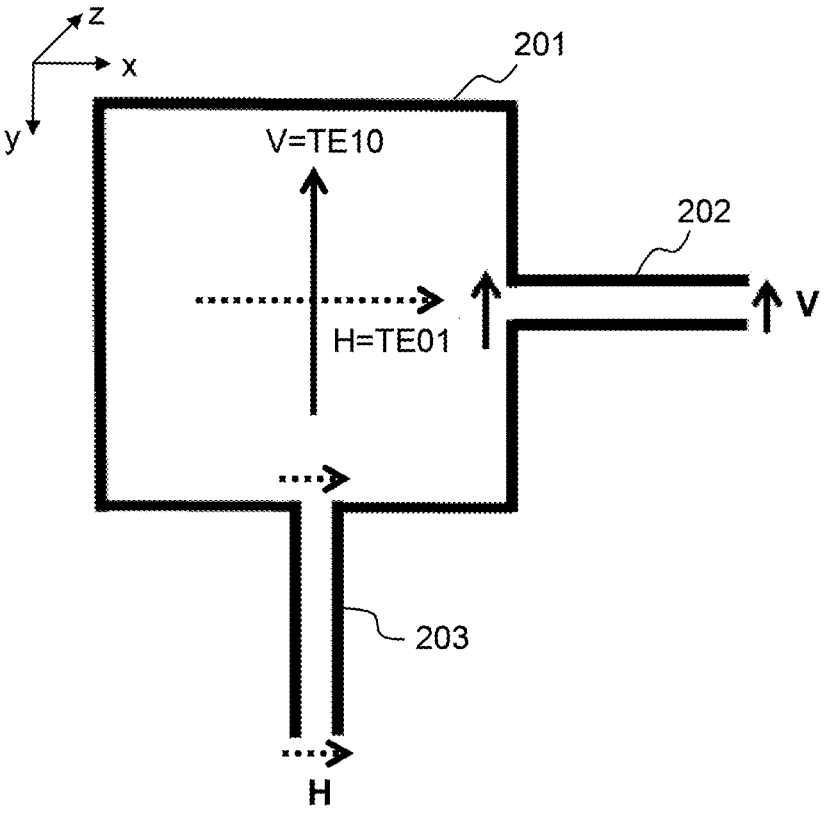
FIG. 2*c* shows an assembly for circularly polarizing and combining signals in an orthomode transducer with two branches.
FIG. 2*d* shows the electric field of the signal injected onto the guided access means 203 of an orthomode transducer with two branches.
FIG. 2*e* shows an assembly for improving the decoupling of an orthomode transducer with two branches.
FIG. 2*f* shows an orthomode transducer with two offset branches.

By virtue of the symmetry properties of the off-centred access means, the orthomode transducer according to the invention as shown in FIG. 5*a* makes it possible to improve decoupling performance by a few dB over orthomode transducers with two arms such as the one shown in FIG. 2*a*, by generating perfectly linear electric fields and by blocking the propagation of the signal from one guided access means to another by design. This orthomode transducer is furthermore more wideband than orthomode transducers with two branches from the prior art, since its symmetry properties mean that it constructs polarization alignments that are always well-oriented, independently of the frequency band under consideration. This is not the case with orthomode transducers with two arms, which are not symmetrical and therefore have to be optimized for a given frequency band.

Figure 5C:
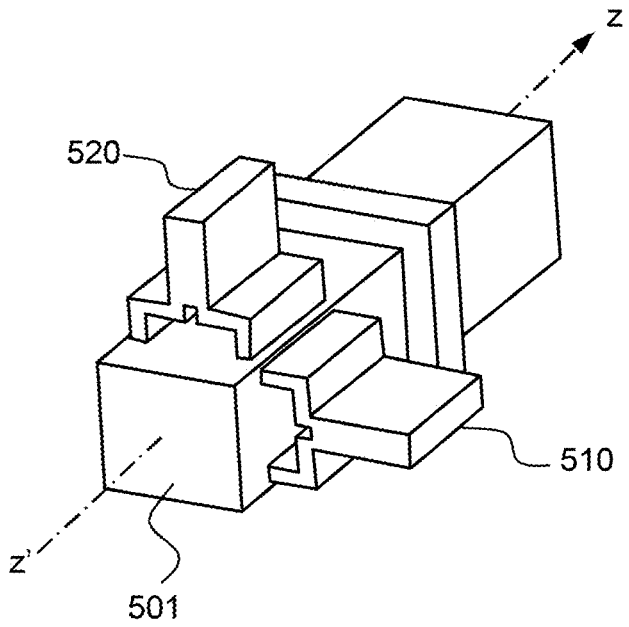
FIG. 5*c* is a three-dimensional depiction of an orthomode transducer according to one embodiment of the invention, FIG. 5*d* distinguishes between the various parts of an orthomode transducer according to one embodiment of the invention for manufacture through milling.

FIG. 5*c* is a three-dimensional depiction of an orthomode transducer according to one embodiment of the invention. It is possible here to see the primary waveguide 501, which has connected to it a first access means 510, for injecting the signal transmitted with a polarization, and a second access means 520, for injecting the signal transmitted with the cross polarization.

Figure 3A:
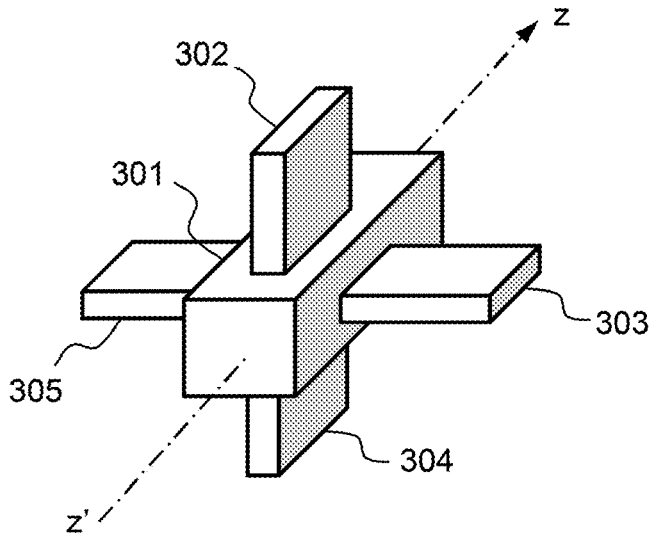
FIG. 3*a* shows a three-dimensional view of an orthomode transducer with four branches according to the prior art, FIG. 3*b* describes the principle of polarizing signals in an orthomode transducer with four branches, FIG. 4*a* roughly shows the electric field in the corner of a waveguide with a square or rectangular cross section, FIG. 4*b* schematically shows the physical principles applicable when injecting a signal via two access means located on the edges of one side of the primary waveguide.
Figure 3B:
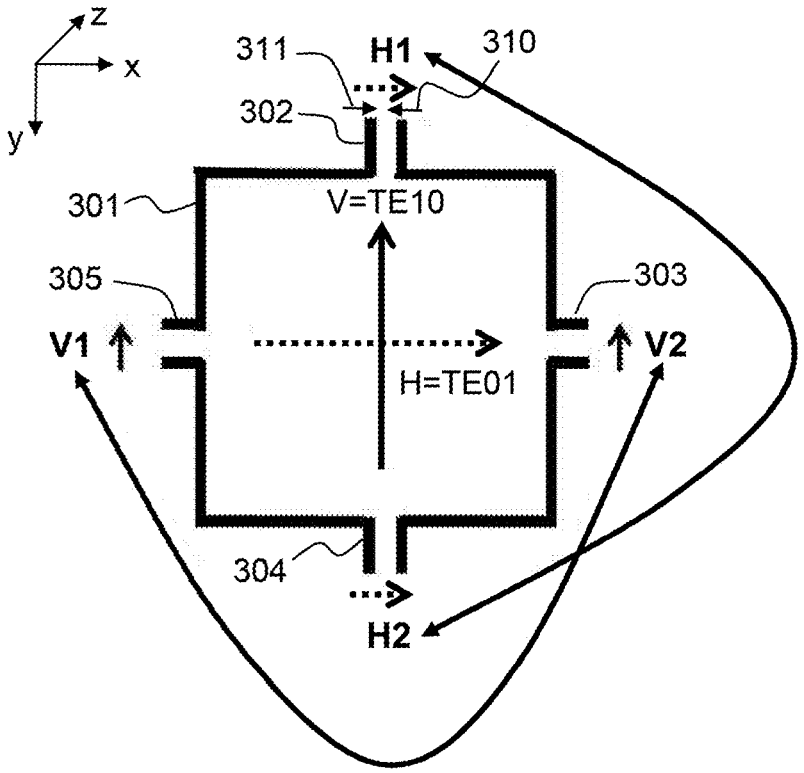

This device has the advantage of being particularly simple and of occupying a volume close to 75% lower in comparison with orthomode transducers with four branches that are connected in pairs, such as the one shown in FIG. 3*a*, this being one of the desired aims of the invention. This compactness is important, notably for producing antenna arrays involving a large number of orthomode transducers arranged in a limited mesh. The reduction in mass is proportional thereto, this also being highly beneficial for producing antenna arrays embedded in the payload of satellites.

Another advantage of the orthomode transducer according to the invention is that the bottom of the cavity of the orthomode transducer (the back of the primary waveguide along the axis zz') remains free. It is therefore possible thereafter to add other access means for processing the polarizations of signals transmitted in another frequency band, or a load acting as termination of the primary waveguide.

Figure 2C:
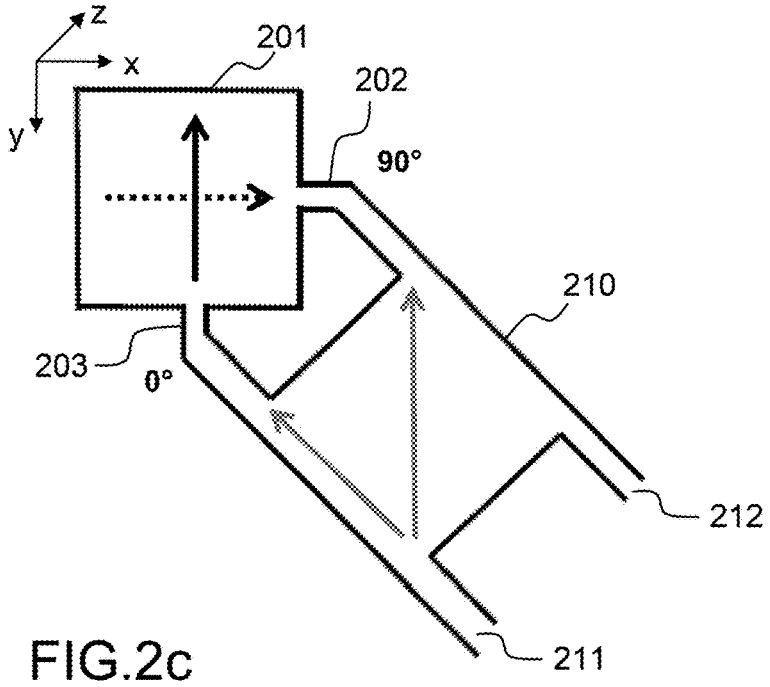
Figure 2D:
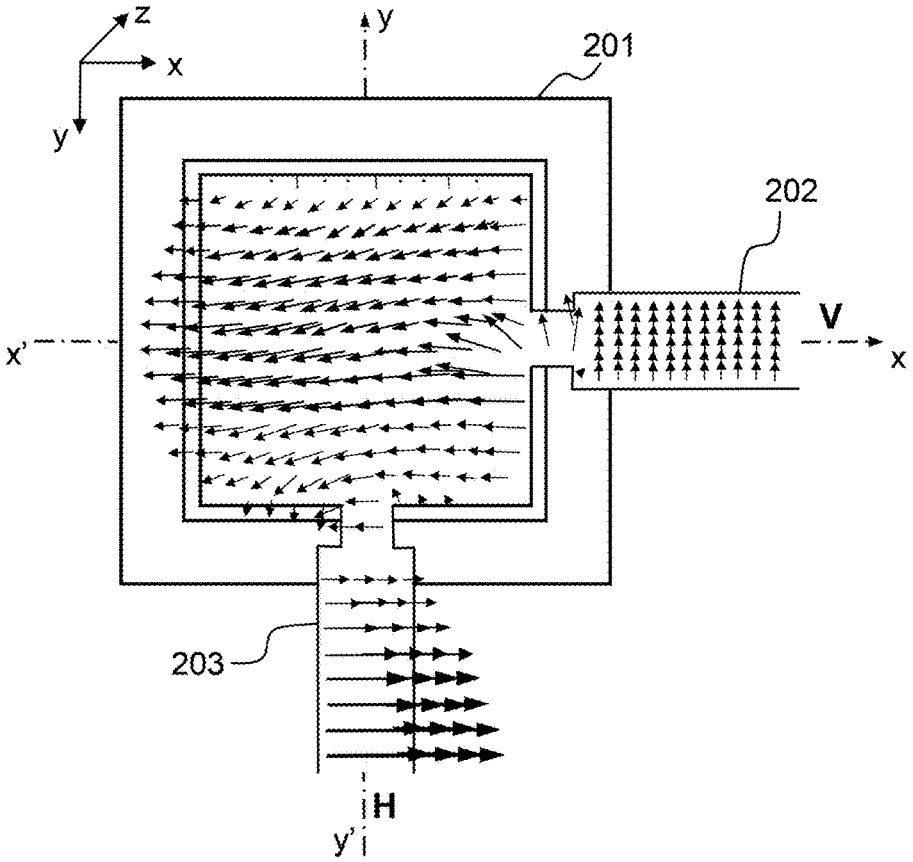
Figure 2E:
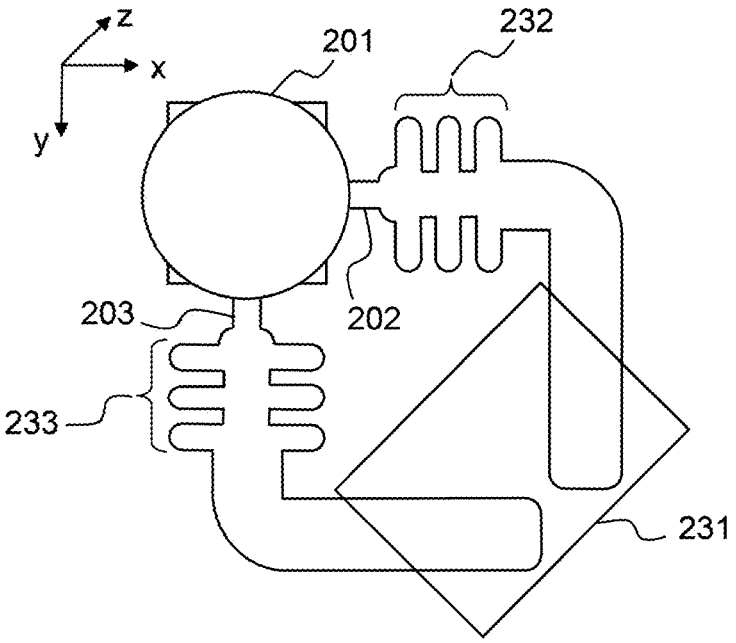
Figure 2F:
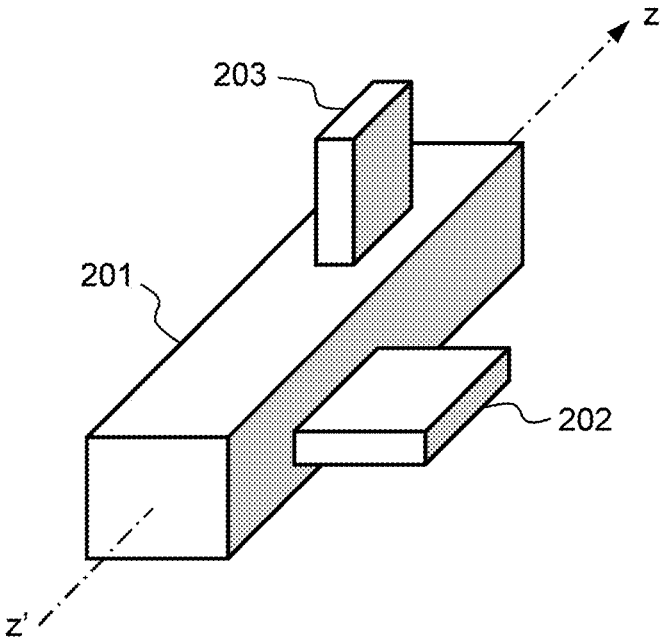

Although the orthomode transducer according to the invention, in which each of the access means comprises a pair of separate arms, makes it possible to polarize signals with orthogonal linear polarizations, it may be combined with a coupler so as to circularly polarize the signals, in a manner comparable to what happens with orthomode transducers with two arms that are known from the prior art, such as the one shown in FIG. 2*c*.

Figure 5D:
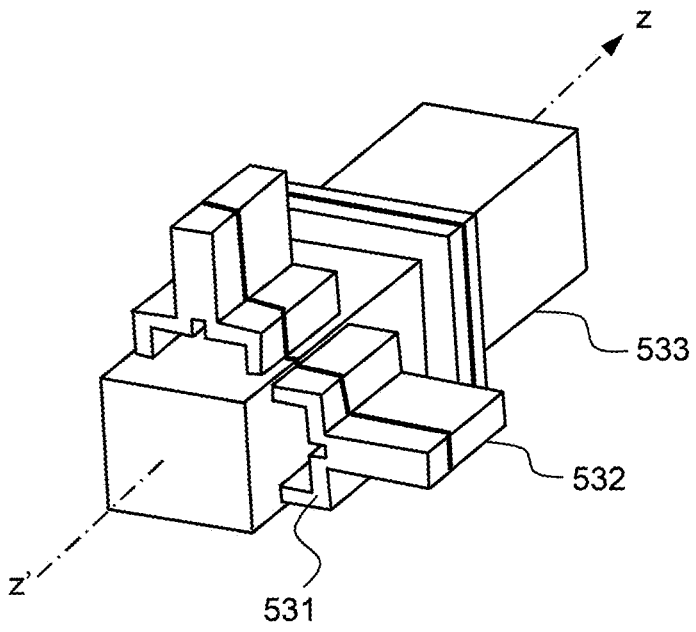

Lastly, it may be contemplated to produce the orthomode transducer according to the invention through additive manufacturing (three-dimensional metal printing) for a low cost or through a milling technique, in only three parts 531, 532 and 533 shown in FIG. 5*d*, the part 533 representing a step for matching the orthomode transducer to the source of the antenna.

Figure 6A:
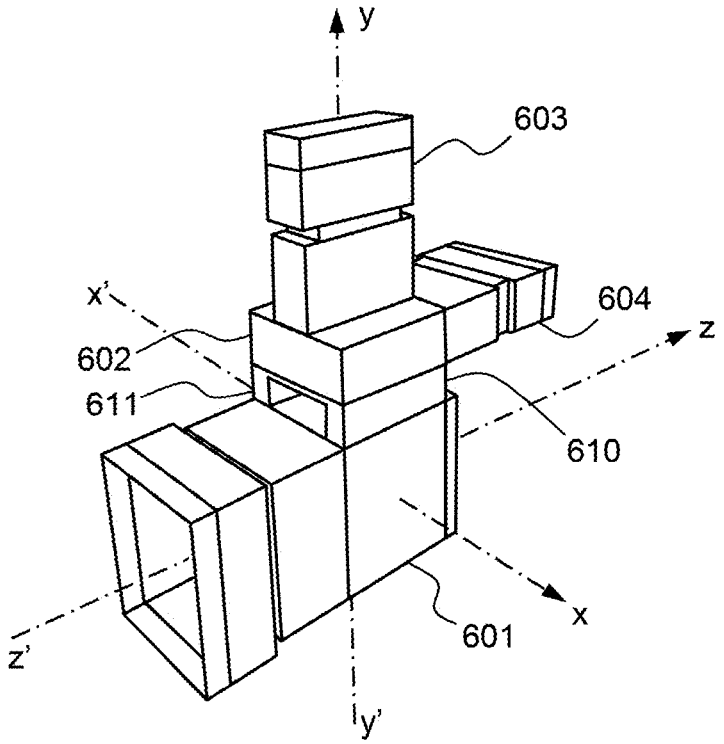
FIG. 6*a* shows one embodiment of an orthomode transducer with two branches according to the invention, FIG. 6*b* distinguishes between the various parts of an orthomode transducer according to one embodiment of the invention for manufacture through milling.

Another embodiment of an orthomode transducer according to the invention is given in FIG. 6*a*. This embodiment still involves a primary waveguide 601, but the guided access means for the two signals with cross polarizations are injected via the same pair of arms.

To this end, the orthomode transducer comprises a device known to those skilled in the art, called magic T-junction. A magic T-junction is a three-dimensional microwave component with four ports: two lateral ports, a sum port and a difference port. It jointly performs the function of an E-plane T-junction and an H-plane T-junction, the lateral ports and the sum port forming the H-plane T-junction and the lateral ports and the difference port forming the E-plane T-junction.

The first access means to the primary waveguide is formed by a waveguide 603 having a free end via which the first signal is injected, and connected to the difference port of the magic T-junction. The two lateral ports of the magic T-junction are connected to two arms 610 and 611, which are themselves connected to the primary waveguide 601 via off-centred access means positioned on the edges of the same side of the primary waveguide, symmetrically about its axis of symmetry yy'.

The second access means to the primary waveguide is formed by a waveguide 604 having a free end via which the second signal is injected, and connected to the sum port of the magic T-junction. The arms of this access means are the arms 610 and 611 connected to the lateral ports of the magic T-junction, just like the first access means.

Using a magic T-junction makes it possible to be able to partition the arms between the two guided access means with orthogonal polarizations. The positioning of the access means makes it possible to obtain orthogonal propagation modes in the primary waveguide 601 with perfectly formed electric fields. Lastly, the positioning and the structure of the access means, associated with the magic T-junction, makes it possible to avoid coupling effects between the two signals with cross polarizations.

The waveguide according to the embodiment shown in FIG. 6*a* makes it possible to obtain very high levels of decoupling, of the order of −70 dB, with an extremely compact device. In comparison with the embodiments presented above, it however operates on a reduced frequency band, given by the operating band of the magic T-junction.

Figure 6B:
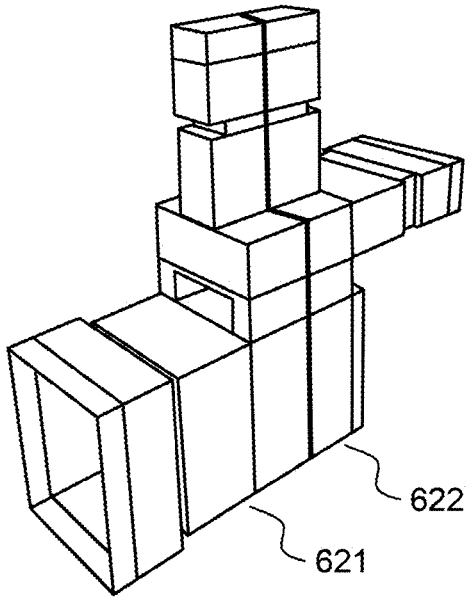

It is very simple to produce since it may be generated by additive manufacturing, or by milling requiring only the assembly of two parts. FIG. 6*b* shows the two parts 621 and 622 required to produce an orthomode transducer according to the invention through milling.

The embodiments presented above for an orthomode transducer according to the invention make it possible to combine signals with orthogonal polarizations in a simple, space-saving and highly effective manner.

The orthomode transducer according to the invention has been described in the case of application of injecting two signals from the free ends of the guided access means into the primary waveguide. However, the invention applies identically to extracting signals from the primary waveguide into the two guided access means. In this case, the T-junctions act as means for combining the signals received by the arms from the primary waveguide. The invention also applies in the same way to injecting a first signal and simultaneously extracting a second signal with cross polarization.

The invention claimed is:

1. An orthomode transducer for transmitting a first signal and a second signal in orthogonal propagation modes, the orthomode transducer comprising:

a primary waveguide with a square or a rectangular cross section and two guided access means comprising:

a free end via which the first signal and the second signal are respectively injected or recovered; and two arms connected to the primary waveguide, wherein each guided access means of the two guided access means comprises a junction configured to connect the free end to the two arms of the respective guided access means, the two arms of each guided access means being connected to the primary waveguide at two off-centered locations on one or more sides of the primary waveguide, the two off-centered locations being symmetrical about an axis of symmetry of the primary waveguide.

2. The orthomode transducer according to claim 1, wherein the two-off centered locations where the two arms of each of said guided access means are connected to the primary waveguide comprise two corners of the same side of the primary waveguide.

3. The orthomode transducer according to claim 1, wherein the junction of each of the two guided access means is configured such that the signals transmitted on the pair of arms of the respective guided access means are in phase or in phase opposition depending on their propagation mode in the primary waveguide.

4. The orthomode transducer according to claim 1, wherein the two arms of the same guided access means have substantially identical dimensions.

5. The orthomode transducer according to claim 1, wherein the guided access means are arranged symmetrically about an axis of symmetry of the primary waveguide.

6. The orthomode transducer according to claim 1, wherein the junction of a first guided access means of said two guided access means defines one of an E-plane T-junction or an H-plane T-junction, wherein the junction of a second guided access means of said two guided access means defines one of an E-plane T-junction or an H-plane T-junction, wherein the two arms of said first guided access means are different than the two arms of said second guided access means.

7. The orthomode transducer according to claim 1, wherein the junction of each of the two guided access means is a common shared junction that defines a magic T-junction and wherein the two arms of the two guided access means share a common shared pair of arms, lateral ports of the common shared junction being connected to the common shared pair of arms, and the first and the second signal being transmitted via two separate ports of the magic T-junction.

8. A device comprising:

the orthomode transducer according to claim 1, and a 90° coupler connected to the free ends of the guided access means of the orthomode transducer so as to circularly polarize the first and the second signal.

9. A transmission chain for a satellite antenna, the transmission chain comprising:

the orthomode transducer according to claim 1, and a source connected to the orthomode transducer.

* * * * *